United States Patent [19]

Ernest et al.

[11] Patent Number: 4,790,093

[45] Date of Patent: Dec. 13, 1988

[54] MOLDED PLASTIC SIGNHOLDER

[75] Inventors: Richard C. Ernest, Lake Forest; Burton L. Siegal, Skokie, both of Ill.

[73] Assignee: Crown Metal Manufacturing Company, Chicago, Ill.

[21] Appl. No.: 92,324

[22] Filed: Sep. 2, 1987

Related U.S. Application Data

[63] Continuation-in-part of Ser. No. 875,721, Jun. 18, 1986, Pat. No. 4,726,132.

[51] Int. Cl.[4] ..... G09F 3/18

[52] U.S. Cl. ..... 40/661; 40/152.1

[58] Field of Search ..... 40/152.1, 607, 642, 40/661

[56] References Cited

U.S. PATENT DOCUMENTS

| | | | |
|---|---|---|---|
| 2,050,136 | 8/1936 | Tucker et al. | 40/152.1 |
| 2,112,583 | 3/1938 | Tucker et al. | 40/152.1 |
| 4,594,802 | 6/1986 | Field | 40/661 |
| 4,726,132 | 2/1988 | Ernest | 40/661 |

*Primary Examiner*—A. Michael Chambers
*Assistant Examiner*—John C. Fox
*Attorney, Agent, or Firm*—Silverman, Cass, Singer & Winburn, Ltd.

[57] ABSTRACT

A two-piece plastic signholder and subassembly therefor. The signholder includes a bracket having a floor and inclined bearing edges which bear against the assembled two substantially identical plastic pieces. The bracket and pieces are designed to provide a bias to ensure a top bearing surface between the upper portions of the two assembled pieces to securely hold signs therebetween. The pieces include positive engagement elongated mating slots and posts along the bottom edge of the pieces, which also include inner and outer inclined or angled bottom edge pieces and the pieces can be curved or warped toward one another to aid in the biasing of the pieces. The pieces alos include a stepped recess and flat support surface in the bottom edge to maintain contact between the bottom edge and the floor of the bracket to resist tipping from side blows.

10 Claims, 2 Drawing Sheets

FIG. 1 PRIOR ART
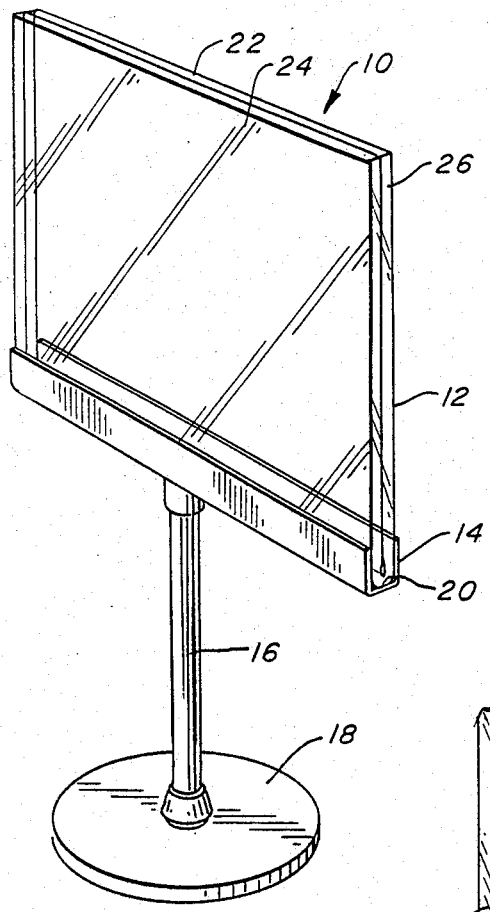
FIG. 2
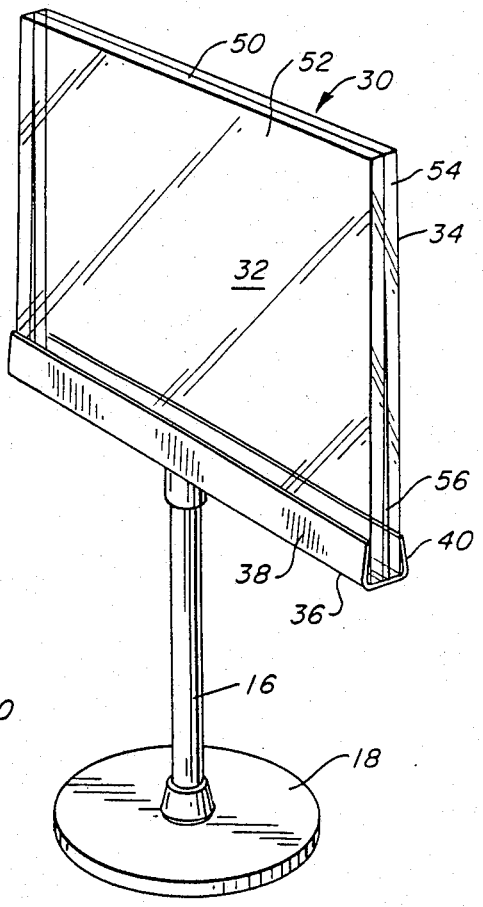
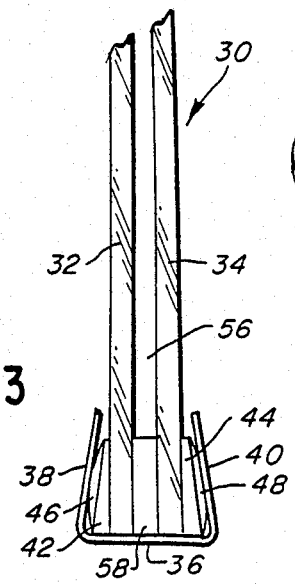
FIG. 3
FIG. 4
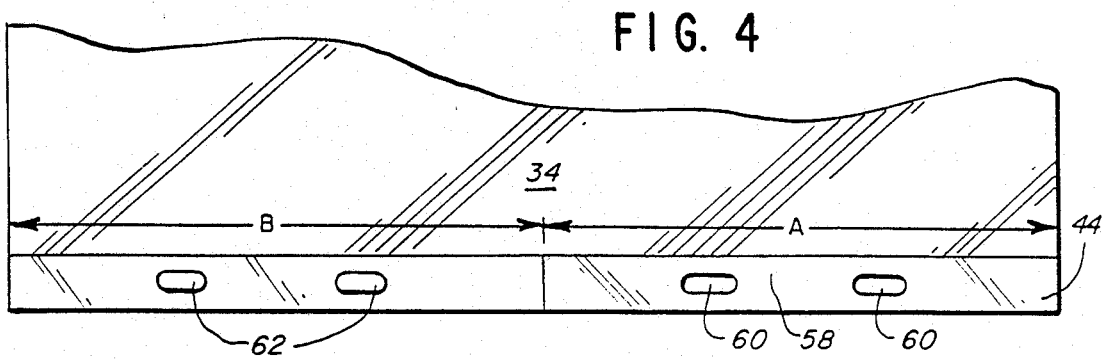

MOLDED PLASTIC SIGNHOLDER

RELATED APPLICATION

This application is a continuation-in-part of U.S. Ser. No. 875,721 filed June 18, 1986 now U.S. Pat. No. 4,726,132, the disclosure of which is incorporated herein by reference.

BACKGROUND OF THE INVENTION

The invention relates generally to plastic signholders and more particularly to an improved two-piece molded plastic signholder and bracket which provides a top bearing surface between the two pieces to clamp signs therebetween.

Any number of types of signholders have been utilized in the past to provide a frame to support display cards, sheets or signs. One popular general type of signholder includes a metal bracket into which the sign can be inserted and which provides a metal support frame around the periphery of the sign. Such signholders are designed to be mounted onto a pedestal, hung from a bracket or mounted to a convenient surface.

Interest has been developed in plastic type signholders which can be mounted along one edge in a metal retaining bracket. The plastic signholders have been developed in one or two pieces with the plastic material providing the support for the sign, poster or card.

The prior art plastic type signholders, as will be further described with respect to FIG. 1, generally have failed to provide an adequate performance for several reasons. The plastic type signholders generally have been glued into the metal retaining brackets and the bond between the signholder and the retaining bracket frequently has failed. Further, the one-piece plastic signholders have been hand folded and the structures of such signholders often have been poor and misaligned. Further, the upper surfaces between the folded or two-piece signholders have often been separated or misaligned such that the signs easily are misaligned or can fall out of the signholders.

It would be desirable to provide a plastic signholder which does not utilize glue for retention in the retaining bracket and which easily can be removed for cleaning or replacement. Further, the signholder should have proper alignment and the upper surfaces should bear against one another to provide a clamping mechanism to firmly hold the sign or card therebetween. The signholder of the parent application Ser. No. 875,721 provided a solution to the problems of the prior art signholders.

The improved plastic signholder of the present invention can provide certain additional advantages not previously obtained. These advantages derive from an improved configuration of the lower margin of the planar mating pieces which formed the previous signholder. In the course of molding these pieces, the lower margins thereof were provided with a depending rounded portion or high spot. This high spot created a condition whereby the signholder potentially was susceptible to lateral misalignment or tipping from side blows during handling. Thus, a side blow to the previous signholder could result in a tilted misalignment of the signholder in its metal retaining bracket, causing an unattractive presentation of the sign. The improved signholder configuration results in greater stability and resistance to side blows.

SUMMARY OF THE INVENTION

The above and other disadvantages of prior art plastic signholders are overcome in accordance with the present invention by providing a two-piece molded plastic signholder and bracket which provides a top bearing surface or area between the two pieces to clamp the signs or cards therebetween. The two molded plastic pieces are substantially identical to one another and include positive engagement interlocking means along the bottom edge thereof to align the two pieces. Each of the pieces form a subassembly for the signholder. The retaining bracket is a U-shaped bracket which includes inwardly inclined bearing edges which bear against inclined bearing means also provided along the bottom edge of the two pieces to ensure that the upper surfaces of the two pieces bear against one another to provide the clamping mechanism. Once the mating pieces are inserted in the retaining bracket, the bracket engages the bearing means to create the clamping force thereon. The bottom edges of the signholder pieces are provided with a stepped recess and an angled flat support surface to increase stability and resistance to side blows. The angled flat surface increases the contact between the bottom edges of the two pieces and the U-shaped metal bracket.

BRIEF DESCRIPTION OF THE DRAWINGS

FIG. 1 is a perspective view of a one-piece prior art plastic signholder;

FIG. 2 is a perspective view of one embodiment of the signholder of the parent application U.S. Ser. No. 875,721;

FIG. 3 is a partial end plan view of the signholder of the signholder of FIG. 2;

FIG. 4 is a partial side plan view of one plastic subassembly piece of the signholder of the parent application;

DESCRIPTION OF THE PREFERRED EMBODIMENTS

Figure 5:
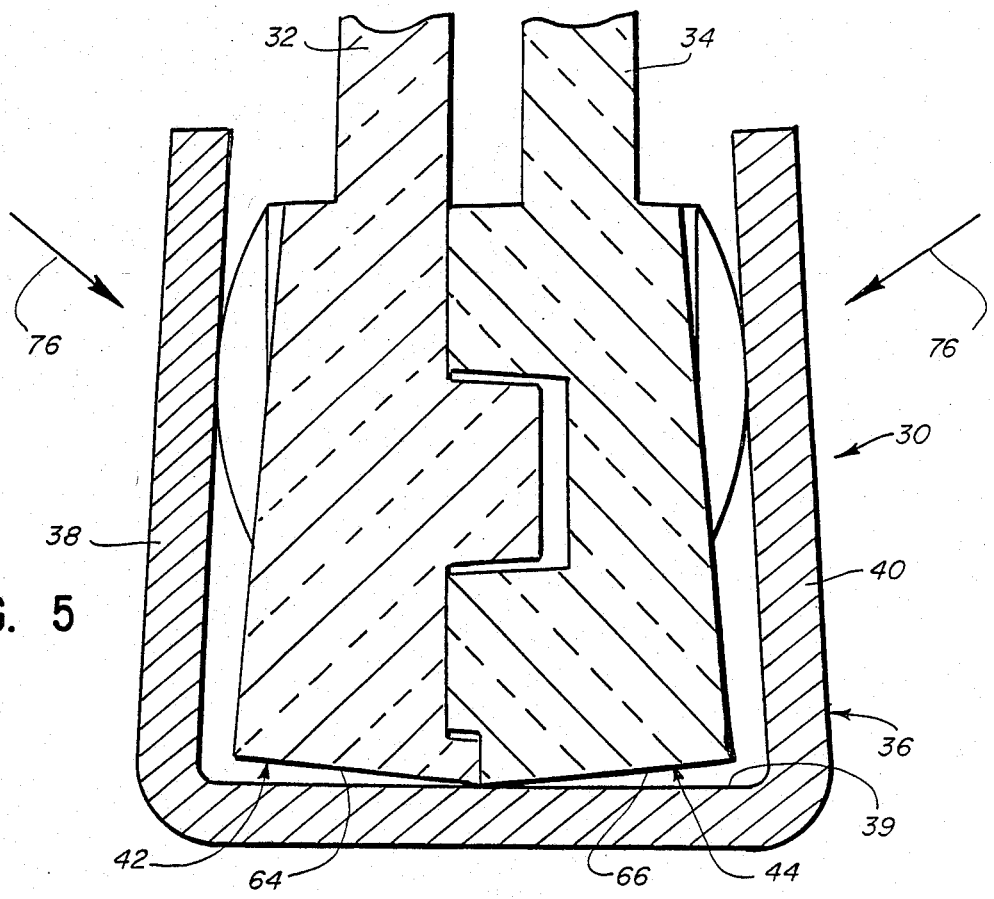
FIG. 5 is an enlarged partial sectional view of the signholder of the parent application U.S. Ser. No. 875,721, exaggerated for illustration.

Referring to FIG. 1, a prior art plastic one-piece signholder 10 is illustrated. The signholder 10 includes a plastic folded sheet 12, which is mounted in one conventional type of metal U-shaped retaining bracket 14. The bracket 14 can be mounted in any number of conventional ways and for illustration purposes is mounted on a post 16 mounted in a pedestal base 18.

The sheet 12 typically is folded around a rod, generally by hand (not illustrated) to form a folded edge 20. The folded edge 20 is mounted into the U-shaped retaining bracket 14 by gluing the sheet 12 into the bracket. The folded sheet 12 thus is mounted into the bracket 14 with an open uppermost edge 22. The open edge is formed by two upper portions 24 and 26 of the sheet 12, which portions are designed to bear against one another at least along the upper edge 22 and preferably for a distance therefrom to provide a sign clamping surface.

Although the signholder 10 has been illustrated with a perfectly aligned top edge 22 and upper portions 24 and 26 bearing against one another, such is often not the result of the folding process. Often the edge 22 is misaligned and also frequently the portions 24 and 26 do not bear against each other uniformly along the length of the edge 26 or at all.

Further, utilization of the signholder 10 often results in the glued bond between the signholder 10 and the bracket 14 being broken and hence the sheet 12 will not be aligned or will fall out of the bracket 14. Also, the cards or signs can include glued labels thereon, which labels can be come glued to the inside of the sheet 12 and hence the whole signholder 10 or at least the sheet 12 must be disposed of.

As an attempt to remedy the shortcomings of the one-piece signholder 10, a two-piece signholder (not illustrated) was developed. The two-piece signholder corrected the problem of the misfolded sheets 12, but still presented the problem of bonding the pieces into the U-shaped bracket 14 by gluing. It then was suggested to clamp the two pieces into the bracket 14 by inclining the upper edges of the bracket 14; however, such a design still did not provide for the proper upper sign clamping mechanism desired.

Referring to FIGS. 2–4, a molded two-piece plastic signholder of the parent application is designated generally by the reference numeral 30. The signholder 30 includes two substantially identical plastic pieces 32 and 34, which interlock together and are friction fitted in a metal retaining bracket 36. The bracket 36 has inwardly inclined or dovetailed side walls 38 and 40, which retain the pieces 32 and 34 therebetween by frictional forces without any gluing. This facilitates the removal of one or both of the pieces 32 and 34 for cleaning or replacement.

As most clearly illustrated in FIGS. 3 and 4, the pieces 32 and 34 have a respective outer bottom edge piece 42 and 44 each of which has a bracket bearing protrusion 46 and 48 extending therefrom. There preferably are two or more of the protrusions spaced along the length of the edge pieces 42 and 44. The edge pieces 42 and 44 are formed at an angle to the plane of the pieces 32 and 34. The angled or inclined pieces 42 and 44 help ensure that the bracket walls 38 and 40 bearing against the protrusions 46 and 48 force the pieces 32 and 34 together at least along an upper edge 50 of the signholder 30. Upper portions 52 and 54 of the pieces 32 and 34 thus form a clamping mechanism for the signs, cards or posters which are mounted into the signholder 30.

Each of the pieces 32 and 34 also includes an inner edge piece providing a space 56 between the lower portions of the pieces 32 and 34. The space 56 provides an opening to assist in inserting the signs or posters into the signholder 30. Only an inner edge piece 58 of the piece 34 is shown since the inner edge pieces only extend one-half the length of the pieces 32 and 34 (see FIG. 4). The inner edge pieces preferably also are angled to be more narrow at their upper edges to further ensure that the two pieces 32 and 34 will bear against one another at the top edge 50. A sufficient bearing or clamping force at the top portion 52 and 54 is important, because the cards or signs may only be inserted into the upper portion of the signholder 30.

The identical formation of the pieces 32 and 34 is best illustrated with respect to the piece 34 illustrated in FIG. 4. The pieces 32 and 34 each form a subassembly for the signholder 30. The inner edge 58 extends a distance "A" of one-half the length of the piece 34 or less to accommodate the mating edge (not illustrated) of the piece 32. The mating edge piece of the piece 32 fits against the plane of the piece 34 along the distance "B". The edge piece 58 includes one or more engagement slots 60. The planar mating portion of the piece 34 also includes elongated engagement posts 62. The slots 60 and the posts 62 fit into respective mating engagement posts and slots on the mating piece 32 when the two pieces are mated together for mounting in the bracket 36. The elongated shape of the slots 60 and posts 62 provide a strong and durable positive engagement means, which can be engaged and disengaged numerous times without failure.

The importance of having the upper portions bear against one another has required the above and other very specific modifications to the pieces 32 and 34. The pieces 32 and 34 preferably are molded with a slight inward warp or curvature to further ensure that the upper portions 52 and 54 bear against one another. The plastic material selected for the pieces 32 and 34 should be clear, have a low cost, be very flexible and shatterproof as well as being readily moldable. In general, the plastic material can be selected from any of a number of clear synthetic plastic materials which are suitable for injection molding. These properties, with the exception of low cost, can be provided by high quality polycarbonate like materials. One specific suitable plastic material is a resin sold by Eastman Kodak Company under the tradename Kodar, which also is a low cost material. Another example of a suitable plastic material is an acrylic type resin.

Referring now to FIG. 5, the signholder of the parent application Ser. No. 875,721 is shown with its original configuration exaggerated for purposes of illustration. It has been found in the course of molding the pieces 32 and 34, that the bottom edges 42 and 44 are provided with upwardly canted surfaces 64 and 66 which have insufficient contact with the floor 39 of the bracket 36. Although the degree of cant has been exaggerated in FIG. 5, in actuality it is sufficient to cause the pieces 32 and 34 to be unstable within the bracket 36. More specifically, the canted surfaces 64 and 66 create a condition whereby a side blow or normal handling may cause the pair of pieces 32,34 to rotate or become misaligned within the bracket 36. The result of this condition would be an inclined sign and an unattractive signholder.

Figure 6:
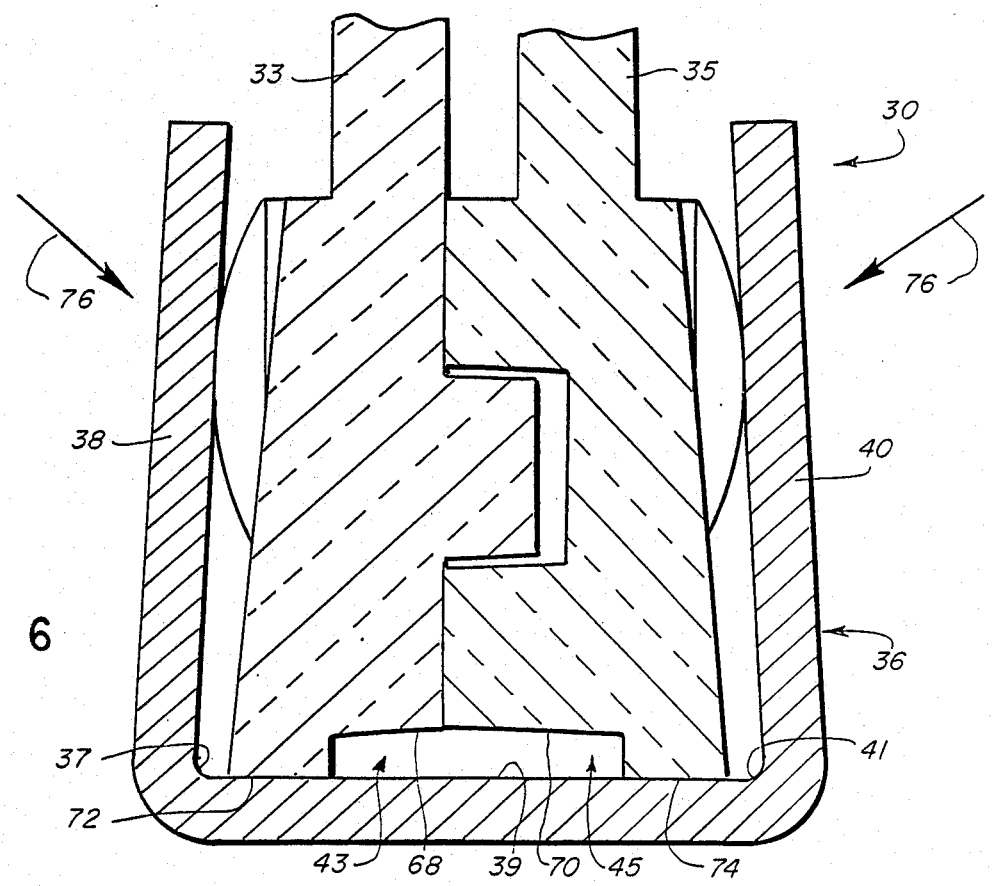
FIG. 6 is a enlarged partial sectional view of the signholder of the invention, exaggerated for illustration.

Referring now to FIG. 6, which depicts the signholder of the invention in exaggerated fashion for purposes of illustration, a pair of plastic pieces 33 and 35 are shown mounted within the bracket 36. The pieces 33 and 35 are identical in configuration to pieces 32 and 34 as shown in FIGS. 3 and 4, with the exception of the bottom edges, 43 and 45. Each of the bottom edges 43 and 45 has been provided with a respective stepped recess 68 and 70, each of which in the preferred embodiment is slightly inclined and extends approximately one-half to seven-eighths of the width of the respective piece 33 and 35, however the dimensions of the recesses 68,70 may be changed to accommodate various applications. The stepped recesses 68,70 extend the length of the pieces 33 and 35.

In addition to the stepped recesses 68,70, the bottom edges 43,45 are each provided with a respective substantially flat inclined surface 72,74 which is in direct contact with the floor 39 of the bracket 36. In the preferred embodiment, the flat surface has been dimensioned to extend as close to the edges 37,41 of the floor 39 as possible without interfering with the operation of the signholder 30.

In the improved version of the signholder 30 of the invention, the downward vector component of the clamping force shown as 76 pushes the mated plastic pieces 33 and 35 down against the inside of the channel, but with the improved configuration, the pieces rest on the flat surfaces 72,74 spaced as far apart as the bracket 36 permits, to provide effective support and great resistance to tipping from side blows or normal handling.

Modifications and variations of the present invention are possible in light of the above teachings. The edge pieces 42, 44 and 58, along with the bracket walls 38 and 40 and the inward warp of the pieces 32 and 34 all provide a biasing means to ensure the formation of the clamping mechanism of the signholder 30. The pieces can be formed in numerous sizes and shapes. It is therefore to be understood that within the scope of the appended claims, the invention may be practiced otherwise than as specifically described.

What is claimed and desired to be secured by Letters Patent of the United States is:

1. A molded plastic signholder subassembly, the subassembly forming half of a mating two-piece signholder assembly, said subassembly comprising:

a clear, flexible molded synthetic plastic substantially planar piece having a face surface, said piece adapted to be mated to a second substantially identical piece and mounted along a bottom edge in a retaining bracket so that said bottom edge contacts said retaining bracket;

said piece including means for biasing said piece in a direction substantially perpendicular to the plane of said piece and toward said second piece when mated therewith to form a bearing surface, and when said mated pieces are inserted in said retaining bracket a gripping action is created between said face surfaces;

means for positively engaging said piece with said second piece when mated therewith; and said bottom edge of said piece having a length, a width and a stepped recess designed to correspond with a similar recess of said second piece to maintain the alignment of said signholder assembly within said bracket.

2. The subassembly as defined in claim 1 wherein said stepped recess extends approximately halfway to seven-eights said width of said bottom edge.

3. The subassembly as defined in claim 1 wherein said recess extends along the entire length of said bottom edge.

4. The subassembly as defined in claim 1 wherein said bracket is U-shaped, with a floor and two canted sides projecting upwardly from the edges thereof.

5. The subassembly as defined in claim 4 wherein said bottom edge of said piece is flat and in substantial contact with said floor of said bracket.

6. The subassembly as defined in claim 5 wherein said bottom edge of said piece extends approximately to one o said edges of said floor of said bracket.

7. A molded plastic signholder comprising:

a dovetail shaped retaining bracket having a floor and a pair of walls projecting vertically from the edges thereof;

a pair of clear, flexible molded synthetic plastic substantially planar pieces having a face surface, said pieces each having a face surface and being substantially identical to one another and adapted to be mated to one another and mounted along corresponding bottom edges in said retaining bracket;

each of said pieces including means for biasing said piece in a direction substantially perpendicular to the plane of said piece and toward the other piece when mated therewith to form a bearing surface, and when inserted in said bracket, a gripping force is created between said face surfaces;

means for positively engaging each o said pieces with one another when mated together; and each of said bottom edges of said pieces having a length, a width and a stepped recess, said recess extending the entire length of said edge, said bottom edge being flat and in substantial contact with said floor of said bracket.

8. The signholder as defined in claim 7 wherein said bottom edge of each of said pieces extends approximately to one edge of said floor of said bracket.

9. The signholder as defined in claim 7 wherein said stepped recess extends approximately one-half to seven-eighths the width of said piece.

10. The signholder as defined in claim 7 wherein said recesses are adjacent each other when said pieces are mated within said bracket.

* * * * *